United States Patent [19]

Stäb

[11] Patent Number: 5,037,076

[45] Date of Patent: Aug. 6, 1991

[54] FOLDER

[75] Inventor: Rudolf Stäb, Frankenthal, Fed. Rep. of Germany

[73] Assignee: Albert-Frankenthal AG, Frankenthal, Fed. Rep. of Germany

[21] Appl. No.: 464,161

[22] Filed: Jan. 12, 1990

[30] Foreign Application Priority Data

Feb. 11, 1989 [DE] Fed. Rep. of Germany ..... 3904074

[51] Int. Cl.[5] ..... B41L 43/08

[52] U.S. Cl. ..... 27/42; 270/6; 270/21.1; 270/47; 270/49

[58] Field of Search ..... 270/2–9, 270/12–18, 21.1, 41, 42, 45–51; 493/324, 344, 345, 361, 362, 424–429

[56] References Cited

U.S. PATENT DOCUMENTS

| | | | |
|---|---|---|---|
| 4,279,410 | 7/1981 | Bolza-Schünemann | 270/50 |
| 4,746,107 | 5/1988 | Schneider | 270/21.1 |
| 4,754,959 | 7/1988 | Kobler | 270/21.1 |

FOREIGN PATENT DOCUMENTS

| | | | |
|---|---|---|---|
| 2921383 | 11/1979 | Fed. Rep. of Germany | 270/42 |

*Primary Examiner*—Edward K. Look
*Assistant Examiner*—Therese M. Newholm
*Attorney, Agent, or Firm*—Jones, Tullar & Cooper

[57] ABSTRACT

In the case of a folder with two production lines which each have a transverse folding means and a conveyor belt extending therefrom and of which at least one is provided with a longitudinal folding means having an associated conveyor belt running through it for the production of a second longitudinal fold, a high degree of ease of operation and accuracy in production are achieved since in the part between the transverse folding means and the longitudinal folding means the two production lines are connected with each other by at least one belt guide branch bridging over the distance between them and this branch is provided with an intake and a delivery bend roll and which together with the bend rolls is mounted on a pivot lever adapted to rock about an axis parallel to the bend roll.

14 Claims, 1 Drawing Sheet

FOLDER

BACKGROUND OF THE INVENTION

The invention relates to a folder for two product lines, preferably in the form of superposed working planes, which each have a transverse folding means and a conveying belt extending therefrom, and of which at least one is provided with a longitudinal folding means, having the associated conveyor belt running through it, for the production of a second longitudinal fold.

A folder of this type has been described in the German specification (DE-OS) 3,626,287. Although in this known folder there is the possibility of supplying products of the two working planes into a common longitudinal or transverse fold delivery there is, however no possibility of placing the products of the two working planes on top of each other prior to making the second longitudinal fold and of jointly providing them with a second longitudinal fold, as may be an advantage in the case of the production of two supplements both to be incorporated in one newspaper.

The European specification (EP-A) 02 10 634 does admittedly describe a folder with two transverse folding means and two conveyor belts extending therefrom, in the case of which the transversely folded products running into the two conveyor belts are placed on top of each other and may be jointly supplied to a subsequent longitudinal folding means for the production of a second longitudinal fold. In this case the conveyor belts coming from the two transverse folding means run together in a forked manner. However these conveyor belts are not adjustable. There is therefore the danger that the products to be placed on each other, if they are not aligned and in register when they enter the fork, will be superposed with a mutual offset, this being a nuisance and being prone to produce difficulties during the production of the second longitudinal fold. Such an imperfect register is however never completely to be avoided in practice. A still further disadvantage of this prior art arrangement is to be seen in the fact that the two transverse folding means are arranged in tandem at generally the same level and that the conveyor belt extending away from the rear transverse folding means is trained generally in the form of a letter U about the front transverse folding means so that access to the latter is impeded. The arrangement in accordance with the European specification (EP-A) 02 10 634 is thus to be regarded as not being sufficiently easy to use and to service.

SUMMARY OF THE PRESENT INVENTION

Taking this state of the art as a starting point, one object of the present invention is accordingly that of so improving a folder of the type initially mentioned that, while still maintaining the advantages of such a known folder design, the transversely folded products of the two product lines are placed on top of each other in perfect register and may be provided with a common longitudinal fold.

In order to achieve this and other objects drawings and drawings, the two product lines are joined together in the zone between the transverse folding means and the longitudinal folding means by at least one branch of a conveyor belt bridging over the distance between them, the branch being associated with bend rolls respectively on the intake side and on the delivery side and which is mounted with the bend rolls on a lever able to pivot about an axis parallel to the bend roll.

These features lead to a simple, modular further development of the folder in accordance with the prior art without sacrificing its advantages as regards ready accessibility to the transverse folding means. By pivoting the conveyor belt branch leading to forming the bypass it is possible to ensure high accuracy of registry without having to adjust the cylinders of the folding means. The features of the invention thus mean that both in the case of faulty operation and also during regular running the equipment is very readily serviced and, respectively, operated.

It is an advantage if the lever is arranged so that it pivots about the axis of a bend roll and more especially about the axis of the bend roll placed on the delivery side of the conveyor belt branch forming the bypass. This ensures a maximization of the effect of the pivot angle of the pivoting lever so that only comparatively small setting distances are required.

In accordance with a further advantageous feature of the invention the bend roll on the inlet side is arranged to cooperate with a pivoting mechanical switch, which is preferably also mounted on the pivoting lever. These features make it possible to disenable the one conveyor belt branch forming the bypass and thus enhance the versatility of production possible with the equipment.

It is convenient if there is a preferably stationary guide deflecting means arranged adjacent to the bend roll on the delivery side. This guide device ensures a reliable guidance of the products at the inlet of the bypass in the second production line.

As part of a further development of the invention, in the context of a folder composed of the various modules able to be differently combined with each other it is possible to achieve a simple possibility of further development if the pivoting lever together with the bend rolls are placed on a module associated with one production line, and adjacent to the other production line spacers are inserted having a breadth equal to the breadth of the module.

Further convenient features and promising developments of the invention will be gathered from the ensuing detailed description of one preferred embodiment of the invention, from the claims and from the drawings.

DETAILED DESCRIPTION OF THE PREFERRED EMBODIMENT OF THE INVENTION

Figure 1:
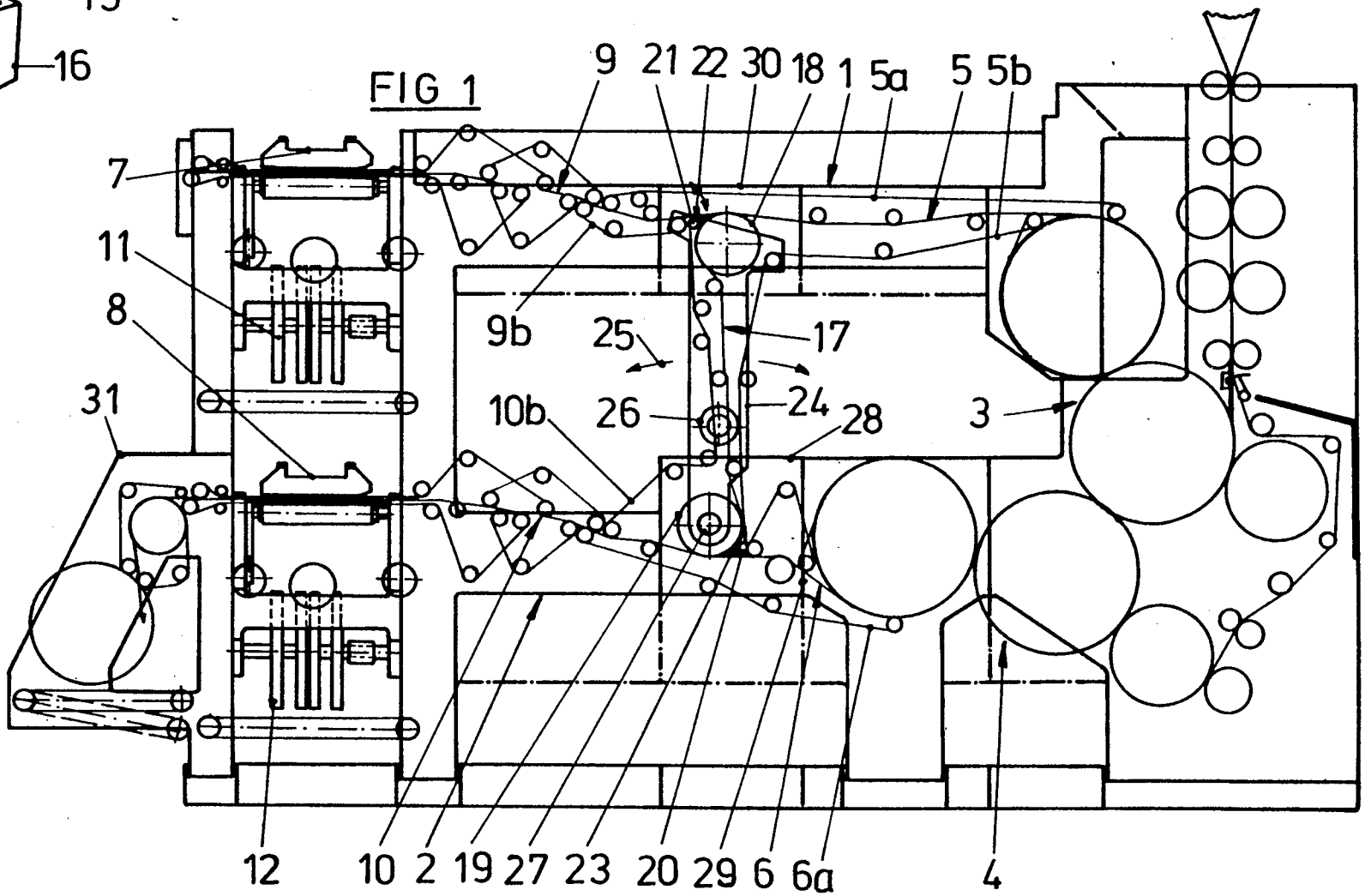
FIG. 1 is a diagrammatic elevation of a folder in accordance with the present invention designed as a module.
Figure 2:
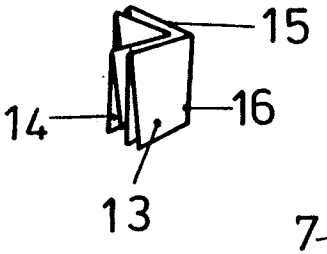
FIG. 2 is a perspective view of the product as produced by the folder in accordance with the present invention.

The folder to be seen in FIG. 1 is designed to have two working planes 1 and 2 which respectively each constitute one production line and are arranged over each other. The planes are each provided with a transverse folding means 3 and, respectively, 4, from which there extends an intake branch 5 and 6, respectively, of a conveyor belt. Adjacent to each production line 1 and 2 there is longitudinal folding means 7 and 8 respectively, designed for the production of a second longitudinal fold and which is designed as a tucker or chopper folder unit through which the output branch 9 and 10 extends and which is respectively associated with a longitudinal fold delivery means 11 and 12. In order to be able to rationally produce two brochures 13 and 14 tucked into each other, the products provided with a transverse fold 15 from the upper and the lower working planes 1 and 2 are placed on top of each other in an aligned manner and while placed on top of each other are provided with a common longitudinal fold 16.

For this purpose, as may be further seen from FIG. 1, there is a conveyor belt branch 17 (bypass branch) which runs from the conveyor belt of the upper production line 1 and runs into the conveyor belt of the lower line 2. This branch 17 runs from the conveyor belt of the upper production line 1 in the part between the intake branch 5 and the delivery branch 9 of the line and adjoins the conveyor belt of the lower production plane in the part between the intake branch 6 and the delivery branch 10 of this lower line. The conveyor belt branch 17, which practically forms a bypass from the upper production line 1 to the lower production line 2 extends in this respect generally vertically downwards.

In order to form the branch point of the bypass branch 17 from the conveyor belt of the upper production line 1 there is an upper bend roll 18. There is a lower bend roll 19 in order to form the intake or transfer point from the bypass branch 17 into the conveyor belt of the lower production line 2. The upper belt array 5*a* of the conveyor belt branch 5 extending from an associated upper folding jaw cylinder is tangent to the upper bend roll 18. The belt array 5*a* passing over the upper bend roll 18 cooperates (downstream from the bend roll 18) with a lower belt array 9*b* (which runs from the bend roll 18) at a position adjacent to the bend roll 18, the belt array 9*b* belonging to the delivery branch 9, extending to the longitudinal folding means 7. The lower belt array 5*b* of the intake branch 5 of the upper conveyor belt runs about the bend roll 18 and into the bypass branch 17. The lower end of the belt array engages the lower bend roll 19 and is diverted about the belt roll 20 adjacent to the bend roll 19. The lower belt array 6*a* of the intake branch 6 of the conveyor belt of the lower working plane 2 runs tangent to the lower bend roll 19 and furthermore the latter has an upper belt array 10*b* of the delivery branch 10 of the conveyor belt in the lower working plane 2 trained around it. This belt array is diverted around a belt roll 21 adjacent to the upper bend roll 18 and accordingly forms a belt assembly which also runs into the bypass branch 17 and engages the upper bend roll 18 and adjacent to the lower bend roll 19 runs out of the bypass branch 17. The bypass branch 17 is accordingly formed by the belt assemblies 5*b* and 10*b* respectively, trained around the upper and lower bend rolls 18 and 19, respectively of the conveyor belts of the upper and, lower working planes 1 and 2, respectively.

In the narrowing gap between the belt array 5*a* tangent to the upper bend roll 18 and the belt array 9*b* trained around the upper bend roll 18 a pivoting mechanical switch 22 is arranged, which is able to be swung between a position fitting under the belt array 5*a* tangent to the bend roll 18 and a position extending through this belt array 5*a*. In order to activate the bypass branch 17, that is to say for transfer of the products, transversely folded in the upper production line 1, into the lower production line 2, the mechanical switch 22 is moved, as illustrated, into the position extending through the belt array 5*a* and running away from the bend roll 18. In this new position the delivery branch 9 is inoperative and the bypass branch 17 is opened. If the bypass branch 17 is to be disenabled the mechanical switch 22, formed by the pivot lever, is so pivoted towards the bend roll 18 that the bypass is closed and the delivery branch 9 of the upper production line 1 is opened, that is to say that the incoming products are moved over and past the intake of the bypass branch 17 and run into the delivery branch 9. In the illustrated form of the invention the mechanical switch 22 is formed by lugs fitting in between the belts of the belt array 5*a* so that the lugs are arranged coaxially with respect to the belt roll 22, which is adjacent to the delivery side peripheral section of the upper bend roll 18. In the vicinity of the belt roll 20 adjacent to the intake side section of the periphery of the lower bend roll 19 there is a deflector device 23 (formed by stationary lugs), which has a deflector surface parallel to the bend roll and a deflector surface parallel to the belt array 6*a* which is tangent to the lower bend roll 19.

In order to ensure high accuracy of registry of the products placed on top of each other, at least one of the bend rolls 18 and 19 is adjustable. In the illustrated working example of the invention the bend rolls 18 and 19 are arranged on a pivoting lever 24 which is able to rock about an axis 27 of the lower bend roll 19. This lever 24 may be so rocked about its axis 27 as indicated by the arrow 25 that the upper bend roll 18 is moved forwards or backwards. Accordingly, the mechanical switch 22 cooperating with the upper bend roll 18, and furthermore the deflector parts, (associated with the belt arrays forming the bypass branch 17) in the form of belt rolls etc. are also mounted on the pivot lever 24. The stationary deflector device 23 arranged adjacent to the lower bend roll 19 which is coaxial to the pivot axis of the pivot lever 24, and the bend roll 20, adjacent to the device 23, may be fixed to the frame of the folder clear of the pivot lever 24.

The pivoting mechanism associated with the pivot lever 24 may be made up of a worm wheel and a worm in mesh with it which is able to be operated by using a handwheel 26. This results in a self-locking or non-reversible action so that accidental loss of the desired setting is out of the question. During operation the pivoting lever 24 is so set that two products to be placed on top of each other are accurately aligned in a superposed position. The mechanical switch 22 is set to the desired type of production prior to starting a run.

The pivot lever 24, which is upright in its center position, has its shaft 27 mounted on a module or modular unit 28 placed in the vicinity of the lower production line 2, the frame of the unit 28 being provided with lateral connection surfaces 29, which fit the connection surfaces of adjacent modules of the folder made up of a plurality of such modules. In the upper production line 1 there are only the spacer members 30 fitting on each side of the pivot 24 in its upright center setting, the breadth of the members 30 being the same as the breadth of the unit 28 and the units being able to be mounted with the end faces against the facing surfaces of the adjacent modular units.

In the folder in accordance with FIG. 1 there is also a transverse folding means 31 arranged following the associated longitudinal folding means 8 so that those belts which run through the longitudinal folding means 8, run into the means 31. The longitudinal folding means 7 and 8 are able to be disenabled. When the longitudinal folding means 8 is disenabled it is possible for the consecutive products 13 and 14 to be delivered without the longitudinal fold via the longitudinal delivery 11.

I claim:

1. A folder for folding products, comprising:

a frame;

means defining first and second production lines, each such production line having a transverse folding means and a conveyor belt extending therefrom, at least one of said production lines having a longitudinal folding means having the associated conveyor belt running through it and being adapted for the production of a second longitudinal fold;

a conveyor belt branch adapted to connect the two production lines at a position between the transverse folding means and the longitudinal folding means;

a bend roll associated with said conveyor belt branch adjacent one of said production lines;

a further bend roll associated with said conveyor belt branch adjacent the other of said production lines; and a pivot lever adapted to pivot about an axis parallel to the axes of the bend rolls and having said conveyor belt branch with said bend rolls mounted thereon.

2. The folder as claimed in claim 1, wherein the pivot lever is adapted to be rocked about the axis of one of said bend rolls.

3. The folder as claimed in claim 2, wherein the pivot lever is adapted to be pivoted about the axis of the bend roll of the conveyor belt branch adjacent said other of said production lines.

4. The folder as claimed in claim 1, wherein said first and second production lines define an upper and a lower superposed working plane in vertical alignment, and wherein said bend roll is associated with said upper working plane and said further bend roll is associated with said lower working plane.

5. The folder as claimed in claim 1, further comprising: a pivoting mechanical switch for cooperation with said bend roll.

6. The folder as claimed in claim 5, wherein the mechanical switch is arranged in a narrowing gap between a belt array tangent to the associated said bend roll and a belt array trained around said bend roll.

7. The folder as claimed in claim 1, further comprising: deflecting means, operatively associated with said further bend roll.

8. The folder as claimed in claim 7, wherein said deflecting means is stationary and is arranged in a narrowing gap between a belt array tangent to the associated said bend roll and a belt array trained around said bend roll.

9. The folder as claimed in claim 6, wherein said belt array comprises an upper belt array, said bend roll has said upper belt array arranged at a tangent to it and has trained around it an associated lower belt array which engages said further bend roll, wherein said upper belt array extends around said further bend roll, and wherein said bend roll, said further bend roll, said upper belt array and said associated lower belt array forming part of said conveyor belt branch.

10. The folder as claimed in claim 6, comprising different modular units which are able to be joined to each other with aligned points of connection, said pivot lever being mounted on a modular unit in one production line and in the other production line spacer members are fitted having a breadth equal to the breadth of the modular unit in that production line.

11. The folder as claimed in claim 10, wherein the modular unit on which said pivot lever is mounted is fitted within the lower production line.

12. The folder as claimed in claim 1, wherein the pivot lever has a middle setting in which it is upright.

13. The folder as claimed in claim 1, wherein the longitudinal fold means is able to be disenabled and is followed by the transverse folding means.

14. The folder as claimed in claim 5, wherein the mechanical switch is mounted on said pivot lever.

* * * * *